US005420678A

United States Patent [19]

Rasch et al.

[11] Patent Number: 5,420,678

[45] Date of Patent: May 30, 1995

[54] PINCH ROLL FOR A RELEASE MATERIAL DELIVERY SYSTEM

[75] Inventors: Kenneth R. Rasch; Frederick C. DeBolt, both of Fairport; Barry J. Gheer, Webster, all of N.Y.

[73] Assignee: Xerox Corporation, Stamford, Conn.

[21] Appl. No.: 268,873

[22] Filed: Jun. 30, 1994

Related U.S. Application Data

[63] Continuation of Ser. No. 90,719, Jul. 13, 1993, abandoned.

[51] Int. Cl.[6] ..... G03G 15/20

[52] U.S. Cl. ..... 355/284; 100/160; 226/187; 226/197; 242/615.2; 492/27

[58] Field of Search ..... 492/27, 57; 355/282, 355/284; 118/DIG. 1, 60, 244, DIG. 15; 226/184, 197, 196, 187; 242/615.2, 615.4; 100/162 B, 155 R, 160

[56] References Cited

U.S. PATENT DOCUMENTS

| | | | |
|---|---|---|---|
| 3,941,558 | 3/1976 | Takiguchi | 432/60 |
| 4,043,296 | 8/1977 | Chu et al. | 492/47 X |
| 4,258,648 | 3/1981 | Leising et al. | 118/60 |
| 4,393,804 | 7/1983 | Nygard et al. | 118/60 |
| 4,557,588 | 12/1985 | Tomosada | 355/300 |
| 4,728,967 | 3/1988 | Tomita et al. | 226/184 X |
| 4,939,552 | 7/1990 | Nakanishi | 355/300 |
| 5,045,890 | 9/1991 | DeBolt et al. | 355/284 |
| 5,049,944 | 9/1991 | DeBolt et al. | 355/284 |
| 5,068,692 | 11/1991 | Menjo | 355/284 |
| 5,209,997 | 5/1993 | Fromm et al. | 355/290 |

FOREIGN PATENT DOCUMENTS

| | | |
|---|---|---|
| 58-184173 | 10/1983 | Japan . |
| 61-251881 | 8/1986 | Japan . |
| 3-12682 | 1/1991 | Japan . |
| 3-65977 | 3/1991 | Japan . |
| 4-179983 | 6/1992 | Japan . |

*Primary Examiner*—A. T. Grimley
*Assistant Examiner*—Nestor R. Ramirez
*Attorney, Agent, or Firm*—Lloyd F. Bean, II

[57] ABSTRACT

A fuser apparatus for heat fusing toner images to print substrate comprising an elongated fuser roll and an elongated pressure roll. The pressure roll is supported for pressure engagement with the fuser roll to form a nip therebetween adapted to receive substrates. An oil impregnated web material and an elongated pinch roll are provided. The pinch roll has an outer surface mounted against the web material to urge the web material into contact with the fuser roll to apply release material to the fuser roll. The outer surface includes a first portion having a diameter and a length, a second portion having a diameter and a length, and a third portion having a diameter and a length. The first portion diameter is greater than the second and third portion diameter. The first portion, second portion and third portion are spaced along the axis of the pinch roller. The second portion and third portion are located at opposite ends of the pinch roll. The first portion adjoins between the second portion and the third portion, thereby when the pinch roll is mounted against the web material into contact with the fuser roll to apply release material to the fuser roll a lesser amount of release material is applied to the fuser roll where the second and third portion is mounted against the web material into contact with the fuser roll.

6 Claims, 4 Drawing Sheets

PINCH ROLL FOR A RELEASE MATERIAL DELIVERY SYSTEM

This application is a File Wrapper Continuation of Application Ser. No. 08/090,719 filed Jul. 13, 1993 by Kenneth R. Rasch et al. and entitled "PINCH ROLL FOR A RELEASE MATERIAL DELIVERY SYSTEM", which is now abandoned.

The present invention relates to a fuser apparatus for electrophotographic printing machines and in particular to a pinch roll for a web delivery system having a heat and pressure roll fuser.

BACKGROUND OF THE INVENTION.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member or substrate permanently by heat, it is necessary to elevate the temperature of the toner material to a point at which constituents of the toner material coalesce and become tacky. This action causes the toner to flow to some extent onto the fibers or pores of the substrate or otherwise upon the surfaces thereof. Thereafter, as the toner material cools, solidification of the toner material occurs causing the toner material to be bonded firmly to the substrate.

One approach to thermal fusing of toner material images onto the supporting substrate has been to pass the substrate with the unfused toner images thereon between a pair of opposed roller members at least one of which is internally heated. During operation of a fusing system of this type, the substrate to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with a compliant material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retrained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material Thus, a low surface energy, easily parted layer is presented to the totters that pass through the fuser nip and thereby prevents toner from adhering to the fuser roll surface.

Various systems have been used to deliver release agent fluid to the fuser roll including the use of oil soaked rolls and wicks with and without supply sumps as well as oil impregnated webs. It has be seen in various systems in which a uniform amount of release fluid can be applied to the surface of the fuser roll. When the copy substrate dimension normal to the direction of travel of the substrate is less than the total length of the fuser roll end of the roll beyond the copy paper (i.e. the portion of the roll surface not in contacted by the copy paper) continuously take on oil without removal thereof while the area contacted by the copy paper has some of the oil removed by the copy paper as it moves through the nip between the fuser roll and pressure roll structures. The foregoing results in the swelling of the ends of the rolls to such a degree that the fuser roll and/or pressure roll coating weakens and blowout occurs resulting in paper handling problems and fuser roll and/or pressure roll failure.

The following references may be of relevance to the present invention:

U.S. Pat. No. 3,941,558
Patentee: Takiguchi
Issued: Mar. 2, 1976
U.S. Pat. No. 4,258,648
Patentee: Leising et al.
Issued: Mar. 31, 1981
U.S. Pat. No. 4,393,804
Patentee: Nygard et al
Issued: Jul. 19, 1983
U.S. Pat. No. 4,557,588
Patentee: Tomosada
Issued Dec. 10, 1985
U.S. Pat. No. 4,939,552
Patentee: Nakanishi
Issued: Jul. 3, 1990
U.S. Pat. No. 5,045,890
Patentee: DeBolt et al.
Issued: Sep. 3, 1991
U.S. Pat. No. 5,049,944
Patentee: DeBolt et al.
Issued: Sep. 17, 1991
JPPN-58-184173 (A)
Patentee: Katou
Published: Oct. 27, 1983
JPPN-61-251881 (A)
Patentee: Takizawa Published: Nov. 8, 1986

The foregoing references may be summarized as follows:

U.S. Pat. No. 3,941,558 discloses a rolled web impregnated with silicone oil for preventing offset. The web has a thickness of two mm, a total length of 50 cm, and travels one cm per thousand copies between the supply and take-up rollers. This system transfers about 0.003 cc of oil to the fuser per copy.

U.S. Pat. No. 4,258,648 discloses a heat and pressure roll fusing apparatus for fixing toner images to copy substrates. The apparatus has a tapered doner roll applicator for the fuser roll.

U.S. Pat. No. 4,393,804 discloses a rolled web system that moves between a supply core and take-up roller. A felt applicator supplies oil from a supply reservoir to the web. The take-up core is driven by a slip clutch at a speed greater than the speed of the pressure roller, thus exerting tension on the web. The web is between one and two mm in thickness and moves at a constant speed of 5 cm per 200 to 1,000 copies.

U.S. Pat. No. 4,557,588 discloses an image forming apparatus such as an electrophotographic copier, microfilm equipment, recording equipment, facsimile or printer. A movable cleaning member is maintained in contact with a member to clean its surface and the movement of the cleaning member is variably controlled according to the state of the image formation.

U.S. Pat. No. 4,939,552 discloses a cleaning device for cleaning the surface of an element of a copying apparatus to be cleaned by contacting a cleaning web therewith is connected to a driving mechanism of a scanning member of the coping apparatus and is driven in correlative movement with the scanning member. It is driven only when the scanning member returns to its original position by a one way clutch and by a constant amount of movement irrespective of the amount of movement of the scanning member.

U.S. Pat. No. 5,045,890 discloses a fuser apparatus for applying offset preventing liquid to a fuser roll including :a supply core; a rotatable take-up core; an oil impregnated web member adapted to be moved from the supply core to the take up core; a motor mechanically coupled to the take up roll for driving the web member from the the supply core to the take up core; a pressure roll in engagement with the web member and positioned to provide a contact nip for the web member with the fuser roll opposite the pressure roll wherein the contact of the web member with the fuser roll transfers oil from the web member to the fuser roll, and a controller to vary the duty cycle operation of the motor to drive the web member at a relatively constant linear speed at the contact nip, the controller including a timer to monitor the cumulative time of operation of the motor to progressively decrease the duty cycle of the motor in response to the cumulative time of operation wherein the progressively decreased duty cycle of operation compensates for the increasing radius of the web member on the take up roll to maintain the relatively constant linear speed at the contact nip.

U.S. Pat. No. 5,049,944 discloses apparatus for applying offset preventing liquid to a fuser roll including an oil impregnated web to be moved relative to a fuser roll. A timer is employed to monitor the cumulative time of operation of a motor used to drive the web relative to the fuser roll and to progressively decrease the cycle of the motor so that essentially a uniform amount of the web is moved at each cycle.

JPPN-58-184173 (A) discloses a fuser apparatus in which one of the rolls is crowned in the center and the other is flared toward one end. The flared roller is also mounted at an angle to the center line of the crowned roller.

JPPN-61-251881 (A) discloses a fixed roller having an inverted crow shape along its length, which engages a belt entrained about two crown shaped rollers to act a part of a fixing device.

Additionally, there are several automatic printing machines commercially available, such as the Xerox 5028 model copier, which employ webs for providing release agents to fuser rolls. Other examples of such commercial devices, presently or currently available, include the Canon model 3225, 3725, 3000 series, 4000 series and 5000 series products. These products also all have liquid release agent impregnated webs supported between a supply roll and a take-up roll and urged into contact with the fuser roll by an open celled foam pinch roll.

In accordance with one aspect of the present invention there is provided an apparatus for applying offset preventing liquid to a fuser roll, comprising a web material having offset preventing liquid in pregnated therein and an elongated pinch roll. The elongated pinch roll has an outer surface mounted in engagement with the web material to urge the web material into contact with the fuser roll to apply the offset preventing liquid to the fuser roll. The pinch roll applies a first pressure over a first region and a second pressure over a second region in the web so that the web applies a greater amount of offset preventing liquid to the fuser roll over the first region than over the second region.

Pursuant to another aspect of the present invention there is provided an apparatus for fusing toner to print substrate, comprising a fuser roll and a pressure-roll. The fuser roll and the pressure roll form a nip with the fuser roll adapted to receive the substrate. A web material having offset preventing liquid in pregnated therein and an elongated pinch roll is provided. The elongated pinch roll has an outer surface mounted in engagement with the web material to urge the web material into contact with the fuser roll to apply the offset preventing liquid to the fuser roll. The pinch roll applies a first pressure over a first region and a second pressure over a second region in the web so that the web applies a greater amount of offset preventing liquid to the fuser roll over the first region than over the second region.

BRIEF DESCRIPTION OF THE DRAWINGS

Other aspects of the present invention will become apparent as the following description proceeds and upon reference to the drawings, in which.

Figure 1:
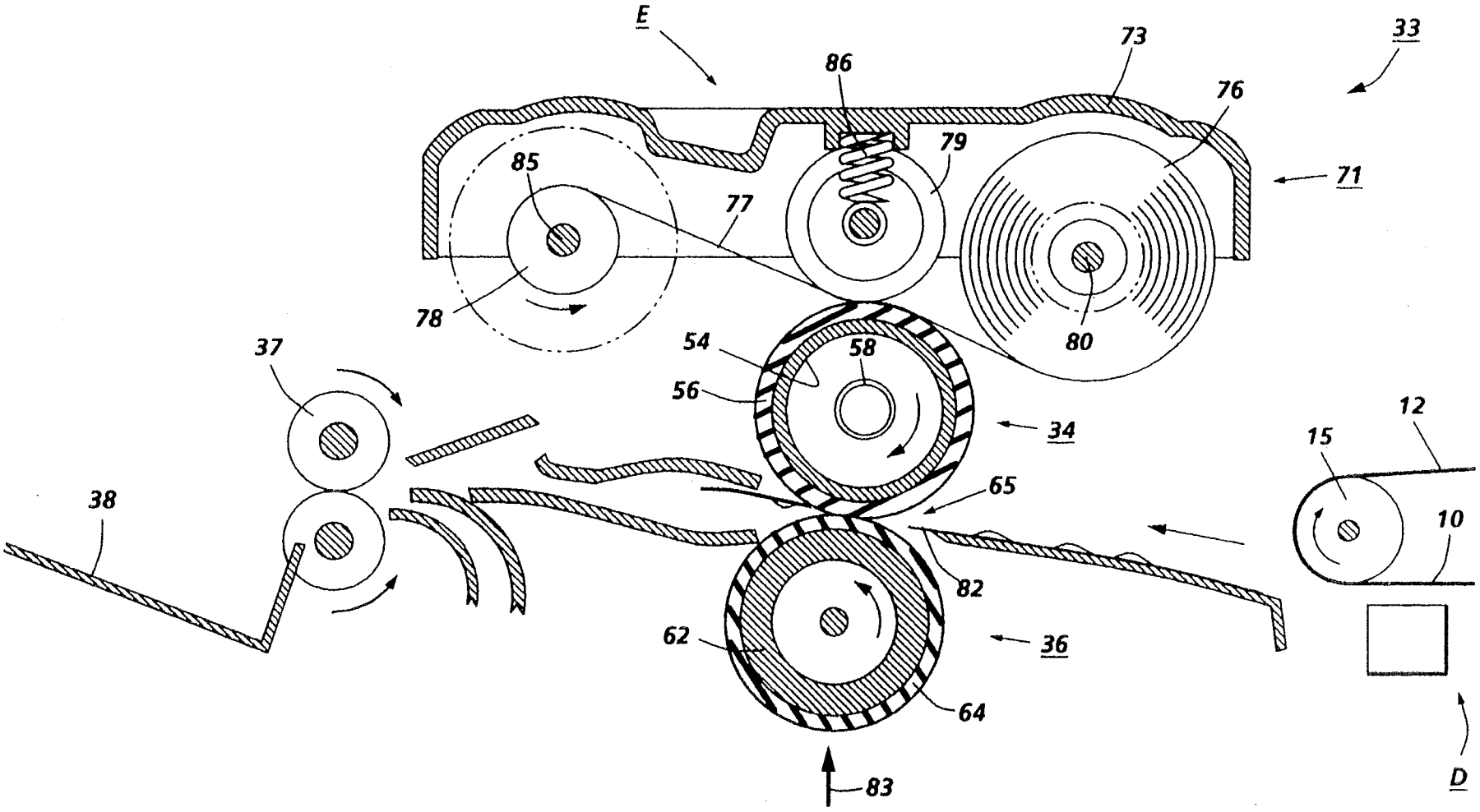
FIG. 1 is a schematic elevational view, partially in section, showing the features of release material delivery system of the present invention therein.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims. For a general understanding of the features of the present invention, references should be made to the drawings. In the drawings, like numerals have been used to identify identical elements.

DETAILED DESCRIPTION

Figure 5:
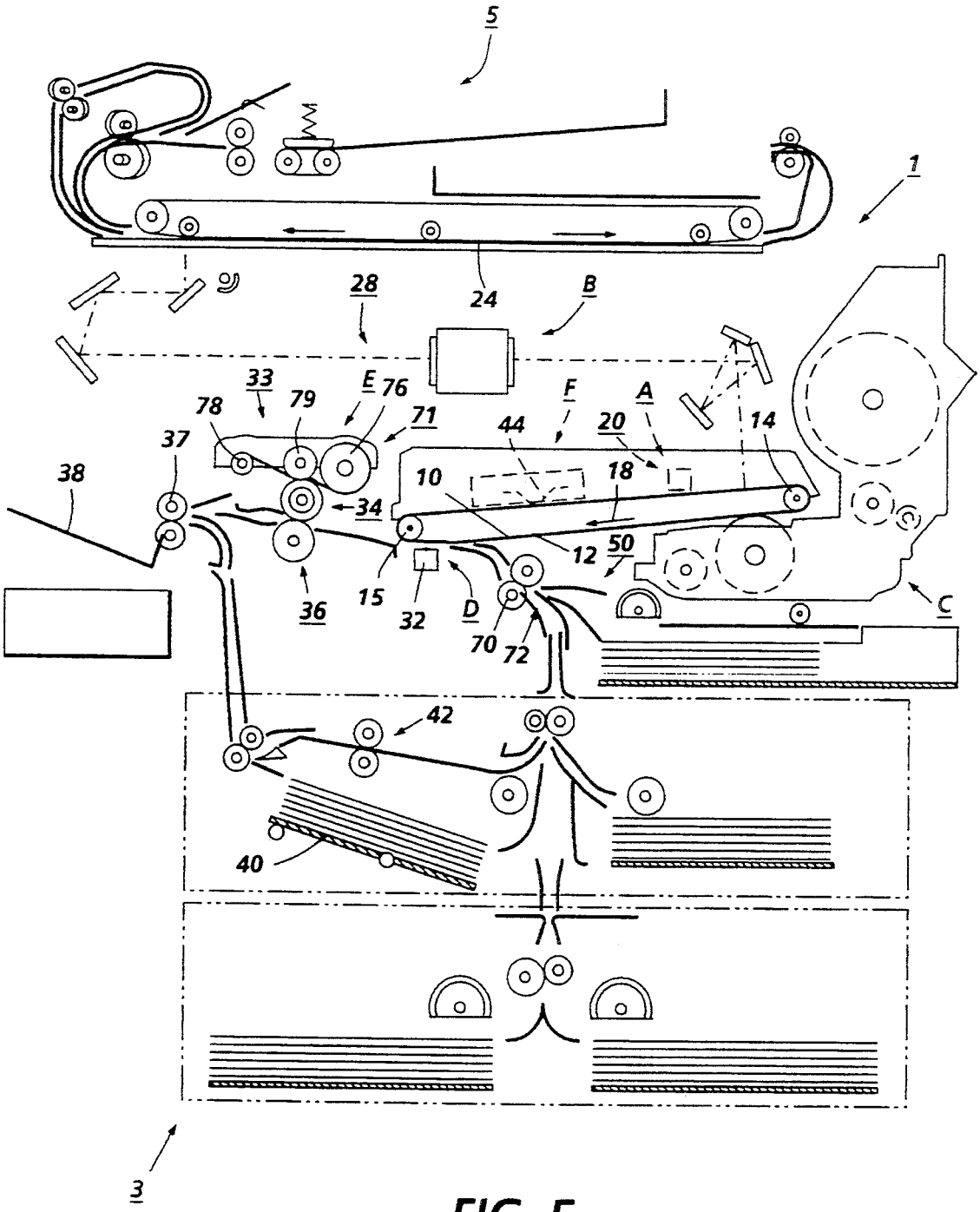
FIG. 5 is a schematic elevational view depicting an illustrative electrophotographic printing machine incorporating the delivery system of the present invention in the fuser assembly thereof.

FIG. 5 schematically depicts an illustrative electrophotographic printing machine of the type in which the present invention may be employed. Specifically, the printing machine 1 of FIG. 3 has both a copy sheet handling system 3 and a document handling system 5 for transporting sheets of material such as paper, Mylar and the like, to and from processing stations of the machine 1. The machine 1, has conventional imaging processing stations associated therewith, including a charging station A, an imaging/exposing station B, a development station C, a transfer station D, a fusing station E, and a cleaning station F. It will be understood that a finishing/sorter station can be incorporated for use with the present machine in a known manner. The machine 1 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 1 can be briefly described as follows:

The photoconductive belt 10 is charged at the charging station A by a corona generating device 20. The charged portion of the belt is then transported by action of the drive roller 14 to the imaging/exposing station B where a latent image is formed on the belt 10 corresponding to the image on a document positioned on a platen 24 via the light lens imaging system 28 of the imaging/exposing station B. It will also be understood that the light lens imaging system can easily be changed to an input/output scanning terminal or an output scanning terminal driven by a data input signal to likewise image the belt 10.

The portion of the belt 10 bearing the latent image is then transported to the development station C where the latent image is developed by electrically charged toner material from a magnetic developer roller 30 of the developer station C. The developed image on the belt is then transported to a transfer station D where the toner image is transferred to a copy sheet substrate transported in the copy sheet handling system 3. In this case, a corona generating device 32 is provided to attract the toner image from the photoconductive belt 10 to the copy sheet substrate. The copy sheet substrate is transported along either path 50 or 72 to the registration rolls 70 for passage through the transfer station D.

The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to the output tray 38 or along a selectable duplex path (i.e., tray 40 and path 42 in the case of the illustrative printing machine of-FIG. 5) for duplexing. The portion of the belt 10 which bore the developed image is then advanced to the cleaning station F where residual toner and charge on the belt is removed by a blade edge 44 and a discharge lamp (not shown). The cycle is then repeated.

Attention is now directed to FIG. 1 from which the invention will be explained in greater detail. Specifically, a heat and pressure fuser apparatus 33, including a web release agent delivery system therefor are schematically illustrated. As shown in FIG. 1, the fuser apparatus 33 comprises a heated fuser roll 34 which is composed of a core 54 having coated thereon a thin layer 56 of an elastomer. The core 54 may be made of various metals such as iron, aluminum, nickel, stainless steel, etc., and various synthetic resins. Aluminum is preferred as the material for the core 54, although this is not critical. The core 54 is hollow and a heating element 58 is generally positioned inside the hollow core to supply the heat for the fusing operation. Heating elements suitable for this purpose are known in the art and may comprise a quartz heater made of a quartz envelope having a tungsten resistance heating element disposed internally thereof The method of providing the necessary heat is not critical to the present invention, and the fuser member can be heated by internal means, external means or a combination of both. Heating means are well known in the art for providing sufficient heat to fuse the toner to the support. The thin fusing elastomer layer may be made of any of the well known materials, for example, RTV and HTV silicone elastomers.

The fuser roll 34 is shown in a pressure contact arrangement with a pressure roll 36. The pressure roll 36 comprises a metal core 62 with a layer 64 of a heat-resistant material. In this assembly, both the fuser roll 34 and the pressure roll 36 are mounted on bearings (not shown). The pressure roll bearings are mechanically loaded,as schematically indicated by the arrow 83 so that the fuser roll 34 and pressure roll 36 are pressed against each other under sufficient pressure to form a nip 65. It is in this nip that the fusing or fixing action takes place with toner images contacting the heated fuser roll 34. The layer 64 may be made of any of the well known materials such as fluorinated ethylene propylene copolymer or silicone rubber.

It is preferred that the fuser and the pressure roll used in conjunction with this invention are of the type described in U.S. patent application Ser. No. 08/000,343, entitled Fuser Mechanism Having Crowned Rolls assigned to Xerox Corporation, which has been incorporated by reference herein. That is, both the fuser roll and the pressure roll have a crown profiled engaging surfaces to form a substantially uniform nip across their lengths and provide a substantially constant nip force and a substantially uniform velocity profile to sheets passing through the nip. However, it will also be understood that the present invention can be used in conjunction with a wide variety of fuser configurations needing a delivery of release fluid to the fuser apparatus.

The liquid release agent delivery or management system 71 of the present invention comprises a housing 73 containing release agent material (not shown) for example, silicone oil. The silicone oil is applied to the surface of the fuser roll 34 via a web of material 77 which is impregnated with the oil which is drawn from supply 76 to a take up roll 78. The web material 77 is impregnated with silicone oil and upon contact with the fuser roll 34, it delivers silicone oil thereto. The web material 77 contacts the fuser roll at a nip formed between the fuser roll 34 and a pinch roll 79 formed of an open cell material for applying a thin coating of silicone thereon for preventing offset of images carried by a paper substrate. The liquid release agent may be selected from those materials which have been conventionally used. Typical release agents include a variety of conventionally used silicone oils including both functional and non-functional oils. Thus, the release agent is selected to be compatible with the rest of the system. It is preferred that the release agent delivery system 71 be of the type disclosed and discussed in U.S. patent application Ser. No. 08/000,151, entitled Improved Web Release Agent System For A Heat And Pressure Fuser assigned to Xerox Corporation, and which has been incorporated by reference herein.

Various other systems have been used to deliver release agent fluid to the fuser roll including the use of oil soaked rolls and wicks with and without supply sumps as well as oil impregnated webs. Another type of RAM system is disclosed in U.S. Pat. No. 4,214,549 issued to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll.

The supply roll 76 and take-up roll 78 are each made from interchangeable rotatable tubular support cores 80 and 85 enable the reversibility of the web. The supply roll core 80 and 85 have a supply of release agent impregnated web material 77 wound around the core and is back tensioned within the housing to resist unwinding by suitable means. The take-up roll 76 is mounted for rotation in the counterclockwise direction in order to transport the web 77 in the direction of the arrow 88. While the web is illustrated as being moved in the the "against" direction relative to the fuser roll 34 it will be appreciated that it could also be moved in the "with" direction. Suitable bearings, gears and a motor (not shown) are provided to advance the impregnated web 77 from the supply roll 76 to the take-up roll 78. The system 71 may be fabricated in accordance with the system disclosed in U.S. Pat. Nos. 5,045,890 and 5,049,944, incorporated herein by reference. The foam pinch roll 79 is spring biased toward the fuser roll by two coil springs 86 (only one being shown), one at each end of the pinch roll mounting slot to apply pressure between the web 77 and the fuser roll 34 to insure delivery of an adequate quantity of release agent to the fuser roll and cleaning thereof.

The open cell foam pinch roll may be made of any suitable material which is resistant to high temperatures of the order of the fusing temperature at 225° C. and does not take a permanent set. Typically, it is a molded silicone rubber foam with open cell about 0.5 millimeters in their maximum dimension cells to enable the storage of release agent.

Figure 2:
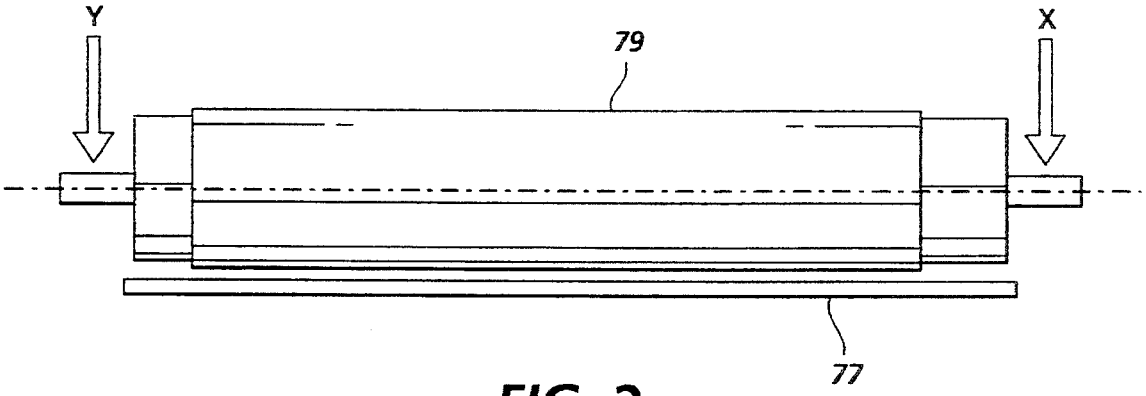
FIG. 2 is an enlarged elevational view of the pinch roll used in the FIG. 1 delivery system.
Figure 3:
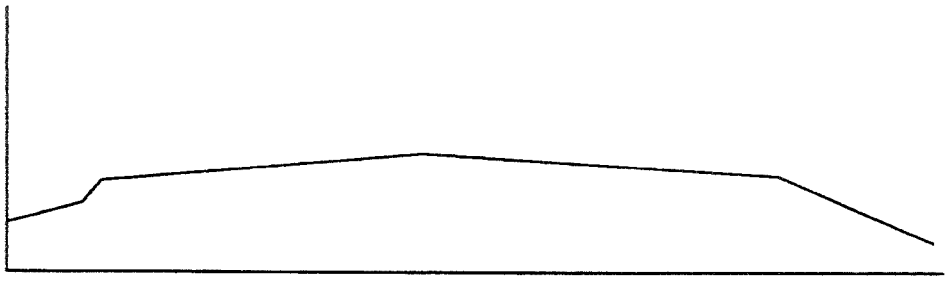
FIG. 3 is a profile of the pressure applied by the pinch roll of the present invention on a web material.

As shown in FIG. 2, the diameter at each end region of the pinch roll is less than the diameter of the center region of the roll, resulting in pressure between the web 77 and the fuser roll 34 to be less on at each end region thereof as shown in FIG. 3. FIG. 3 is a pressure profile of the pinch roll of the present invention on the web with two equal loads X and Y, respectively, on each end of the pinch roll. Preferably, loads X and Y are loaded to the fuser roll with a force of about 1.5 pounds. If the force is less than about 1.5 pounds the web does not wrap correctly on the take-up roll resulting in premature failure. It has been found that minimizing the pressure applied on the web material at each end of the web which is in contact with the fuser roll reduces the amount of release agent supplied to each end region of the fuser roll, preferably not the area of contact corresponds to that would be contacted by the width of the most used copy paper (.i.e. an 11 inch copy paper) moving through the nip formed by the fuser roll and pressure roll. In the foregoing manner, release agent is applied in a greater amount to the area of the surface of the fuser roll which is contacted by the most used copy paper. Accordingly, release agent is applied in a lesser amount beyond the edges of the most used copy paper of the roll allowing sufficient cleaning of rolls when wider less frequently used copy paper is employed and thus, reduces swelling and blow out of each end of the fuser roll and/or pressure roll to increase the life of the fuser roll and pressure roll.

Figure 4:
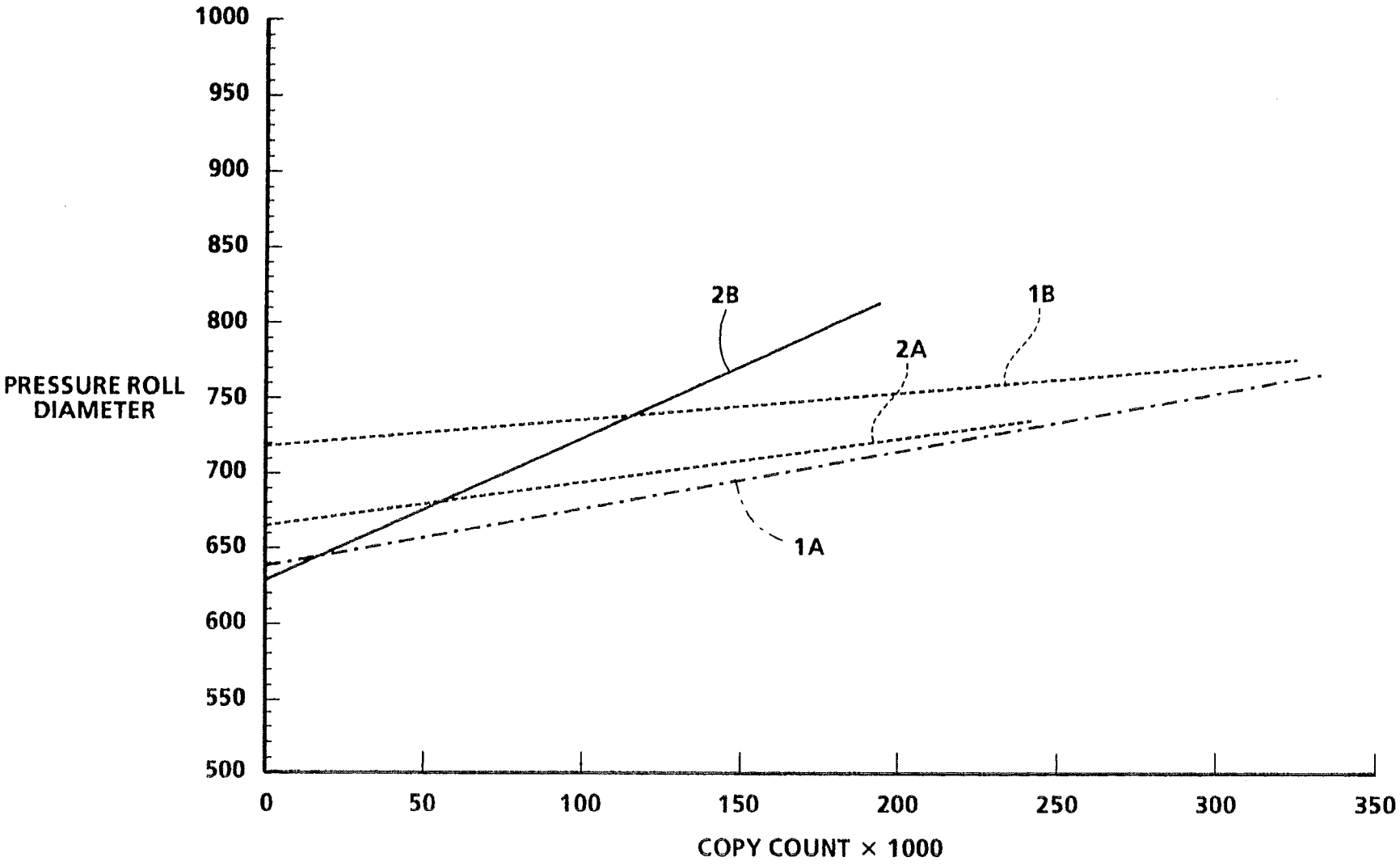
FIG. 4 is a graph showing the test results with the pinch roll of the present invention, and a uniform diameter pinch roll installed in an electrographic printing machine.

An electrophotographic printing machine of the type depicted in FIG. 5 was- tested with the pinch roll of the present invention reduced to practice was installed and a pinch roll with uniform diameter was installed. Now referring to FIG. 4 which is graphical representation on the data collect in the testing of the two pinch rolls showing the changing diameter of a pressure roll during an end of life test with various webs configurations. Line 1A and Line 1B represent present invention reduce to practice installed, in this embodiment the pinch roll was approximately 310 mm long, the central region had a diameter of 20 mm, one end region had a diameter of 15 mm and a length of 10 mm. The other end region had a diameter of 15 mm and a length of 20 mm. The pressure roll of line 1A had an initial diameter of 28.640 mm and was tested with in a shorten web. It was found that the pressure roll of line 1A failed at 331K copies. The pressure roll of line 1B had an initial diameter of 28.720 mm and was tested with in a full web. It was found that the pressure roll of line 1B failed at 324K copies. Line 2A and Line 2B represent pinch roll with a uniform diameter installed in this embodiment the pinch roll was approximately 310 mm long with a diameter of 20 mm. The pressure roll of line 2A had an initial diameter of 28.665 mm and was tested with in a shorten web. It was found that the pressure roll of line 2A failed at 242K copies. The pressure roll of line 2B had an initial diameter of 28.630 mm and was tested with in a full web. It was found that the pressure roll of line 1B failed at 164K copies.

In recapitulation, there has been described an apparatus for applying offset preventing liquid to a fuser roll, comprising a web material having offset printing liquid in pregnated therein. An elongated pinch roll having an outer surface mounted in engagement with the web material to urge the web material into contact with the fuser roll to apply the offset preventing liquid to the fuser roll. The pinch roll applying a first pressure over a first region and a second pressure over a second region in the web so that the web applies a greater amount of offset preventing liquid to the fuser roll over the first region than over the second region.

It is, therefore, apparent that there has been provided in accordance with the present invention, a release material delivery system for use in a fuser apparatus of the type used in electrophotographic printing machines that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. Apparatus for applying offset preventing liquid to a fuser roll, comprising:

a web material having offset preventing liquid impregnated therein; and an elongated pinch roll having an outer surface mounted in engagement with said web material to urge said web material into contact with the fuser roll surface to apply the offset preventing liquid to the fuser roll surface, said pinch roll having a uniform diameter over a first region on said web to apply a first amount of offset preventing liquid on a first portion of said fuser roll associated with the first region of said pinch and a second uniform diameter over a second region on said web to apply a second amount of offset preventing liquid on a second portion of said fuser roll associated with the second region of said pinch rolls with the first region being contiguous to the second region.

2. The apparatus of claim 1, wherein the first region of said pinch roll comprises a central portion thereof, and the second region of said pinch roll comprises opposed marginal end portions.

3. The apparatus of claim 2, wherein the central portion of said pinch roll comprises a greater diameter than the opposed marginal end portions thereof.

4. An apparatus for fusing toner to print substrate, comprising:

a fuser roll;

a pressure roll, forming a nip with said fuser roll adapted to receive the substrate;

a web material having offset preventing liquid impregnated therein; and an elongated pinch roll having an outer surface mounted in engagement with said web material to urge said web material into contact with the fuser roll surface to apply the offset preventing liquid to the fuser roll surface, said pinch roll having a uniform diameter over a first region on said web to apply a first amount of offset preventing liquid on a first portion of said fuser roll associated with the first region of said pinch and a second uniform diameter over a second region on said web to apply a second amount of offset preventing liquid on a second portion of said fuser roll associated with the second region of said pinch rolls with the first region being contiguous to the second region.

5. The apparatus of claim 4, wherein the first region of said pinch roll comprises a central portion thereof, and the second region of said pinch roll comprises opposed marginal end portions.

6. The apparatus of claim 5, wherein the central portion of said pinch roll comprises a greater diameter than the opposed marginal end portions thereof.

* * * * *